United States Patent [19]

Masters

[11] Patent Number: 4,744,327

[45] Date of Patent: May 17, 1988

[54] KAYAK FOOT BRACE

[76] Inventor: William E. Masters, P.O. Box 686, Liberty, S.C. 29657

[21] Appl. No.: 912,609

[22] Filed: Sep. 29, 1986

[51] Int. Cl.[4] ..... B63B 35/71

[52] U.S. Cl. ..... 114/347; 114/363

[58] Field of Search ..... 114/343, 347, 363, 362, 114/270

[56] References Cited

U.S. PATENT DOCUMENTS

| | | | |
|---|---|---|---|
| 3,848,921 | 11/1974 | Rhodes | 114/363 |
| 3,851,916 | 12/1974 | Quartullo | 114/363 |
| 3,982,293 | 9/1976 | Lagervall | 114/363 |
| 4,589,365 | 5/1986 | Masters | 114/363 |

FOREIGN PATENT DOCUMENTS

| | | | |
|---|---|---|---|
| 130793 | 6/1902 | Fed. Rep. of Germany | 248/244 |
| 2001247 | 7/1971 | Fed. Rep. of Germany | 114/347 |
| 3339883 | 5/1985 | Fed. Rep. of Germany | 114/363 |
| 175675 | 3/1922 | United Kingdom | 248/244 |

*Primary Examiner*—Joseph F. Peters, Jr.

*Assistant Examiner*—Stephen P. Avila

*Attorney, Agent, or Firm*—Cort Flint

[57] ABSTRACT

A foot brace (A) is disclosed for a kayak (10) wherein the foot brace (A) is mounted to opposing interior sides of a hull (12) of the kayak. Each foot brace (A) includes an elongated adjusting brace bar (22) slidably carried by an adjusting bracket (20) along the interior side (12*a*) of hull (12). At a forward end (22*a*) of brace bar (22), a foot rest (24) is carried. The opposing aft end (22*b*) of brace bar (22) is slidably received in a cam bracket 52 and an attachment bracket (50) of adjusting bracket 20. A cam (54) is received in an opening (36) formed in brace bar (22) to lock the brace bar in a desired forward-aft position. Adjusting bracket (20) allows adjustment of the brace bar (22) in the forward and aft directions to facilitate the proper support and bracing of a foot (18*b*) of a boater (18). The adjusting bracket (20) and locking cam (54) may be easily operated by the boater while seated in a cockpit (16) of the kayak by manually operating a cam operator (56) from the seat of the cockpit.

18 Claims, 2 Drawing Sheets

Fig. 5-A.

KAYAK FOOT BRACE

BACKGROUND OF THE INVENTION

The invention relates to an adjustable foot brace for a lightweight, flexible skin kayak and the like which may be easily adjusted from the cockpit of the kayak.

Kayaks have become increasingly popular for use in whitewater recreational sports. Under whitewater conditions, the kayak undergoes considerable dynamic forces as it drops from high falls, impacts rocks, makes sharp turns, and other rigors involved in whitewater travel. The boater must maintain himself in a stable position with hip, thighs, and feet braced within the kayak. The kayak may be constructed of a thin flexible, yet strong, plastic skin such as disclosed in U.S. Pat. No. 4,227,272.

In order for the boater to adequately brace himself in a stable position within the kayak so that he may retain control, the bracing must be provided so that the boater may adjust his position.

Heretofore, numerous foot braces have been proposed for kayaks. In many instances, the foot brace provided requires that the boater be able to reach to the point where the foot reaches a foot rest. For example, rails may be attached to interior sides of the kayak hull and foot rests may be removably attached to the rails by various means such as pins. This typically is the point furthest towards the bow of the boat away from the area where the boater is seated. The necessity to reach inwardly is both awkward and often virtually impossible unless the boater is reaching into kayak from an unseated position.

Attempts have been made to provide a foot brace for a kayak which can be adjusted from the cockpit such as shown in Great Britain Pat. No. GB 2,134,454. However, this foot rest requires considerable structure and attachment to the hull and occupies a good bit of the hull interior making such impractical. U.S. Pat. No. 4,229,850 discloses a foot brace having a number of stationary foot positions so that the brace need not be adjusted but that the foot may be adjusted in the brace. However, the need for providing a plurality of foot rests with only a limited variety of positions and the possibility of the boater placing his feet at unequal foot rest positions renders such a device not entirely satisfactory.

Accordingly, an object of the invention is to provide a foot brace for a whitewater kayak and the like which may be easily adjusted from the kayak cockpit yet is simple in construction.

Another object of the invention is to provide a foot brace for a kayak which may be adjusted from the cockpit area and does not require a considerable amount of space within the hull of the kayak.

Another object of the invention is to provide a foot brace for the kayak which may be adjusted easily from the cockpit area by the boater while seated in the cockpit and may be set in a variety of positions in a self-locking manner.

SUMMARY OF THE INVENTION

The above rejections are accomplished according to the present invention by providing an adjustable foot brace for a kayak which includes an adjusting bracket mounted in the cockpit area which may be reached by a boater seated in the cockpit. A sliding brace bar is slidably received by the adjusting bracket so that the brace bar may slide forward and aft with respect to the hull. At the end of the brace bar remote from the adjusting bracket is a foot rest. A shock absorbing pad may be carried by the foot rest. The adjusting bracket includes a pin for locking the brace bar in a number of positions. A cam operator on the adjusting bracket locks and releases the pin so that the brace bar may be moved by the foot of the boater in the forward or aft direction to position the foot rest accordingly. In this manner, the foot rest position may be adjusted, and locked, or released by the boater manually while seated in the cockpit.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 5 and 5A illustrate a foot rest which may be adjustably positioned on a brace bar of a foot brace constructed in accordance with the present invention;

DESCRIPTION OF A PREFERRED EMBODIMENT

Figure 1:
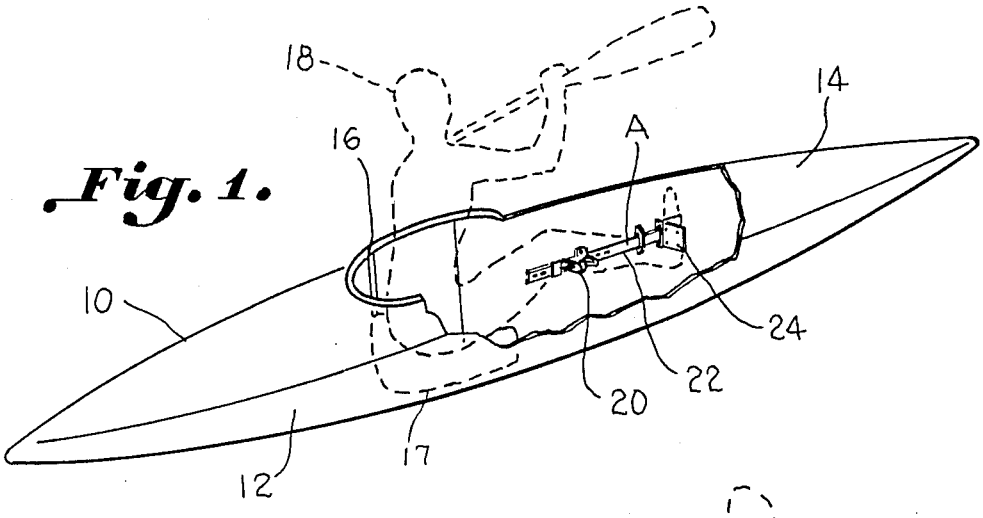
FIG. 1 is a perspective view of a kayak with part of the hull and deck cut away to illustrate a foot brace constructed in accordance with the present invention.

Referring now in more detail to the drawings, a kayak 10 is illustrated in FIG. 1 which includes a hull 12 and a deck 14. A cockpit 16 is formed in the deck which may be occupied by a boater 18 in a seated position with knees slightly bent. In this position, the hips of the boater are braced in a seat 17 and the thighs braced against thigh braces (not shown) attached to the inside of the hull. A foot brace A which can be seen is mounted to each interior side 12*a* of the hull 12 by suitable means such as conventional fasteners. As can best be seen in FIG. 2, each foot brace A includes an adjusting bracket 20, a brace bar 22, and a foot rest 24. An intermediate bracket 26 may also be utilized. Adjusting bracket 20 is attached directly to the skin 12*b* of hull 12 by conventional fasteners 28. Likewise, intermediate bracket 26 may also be attached to the hull. Foot rest 24 includes a planar foot rest surface 30 having reinforcing ribs 32 on the backside. Holes 34 are provided for attaching a shock absorbing pad to the planar foot rest 30. Shock absorbtion may be provided by a foam cushion pad 35 attached to planar surface 30. Alternately, an outer pad (not shown) may be attached by pins through holes 34 with springs between the outer pad and planar surface 30. In many instances, under whitewater conditions, ankles of boaters have been broken due to severe impact of the kayak when the foot of the boater is braced against a rigid surface. Accordingly, it may be desirable in many instances to attach a cushion pad to the planar surface or even cushion/-spring combination pad to absorb the shock against the boater's foot when bracing against severe impact.

Figure 2:
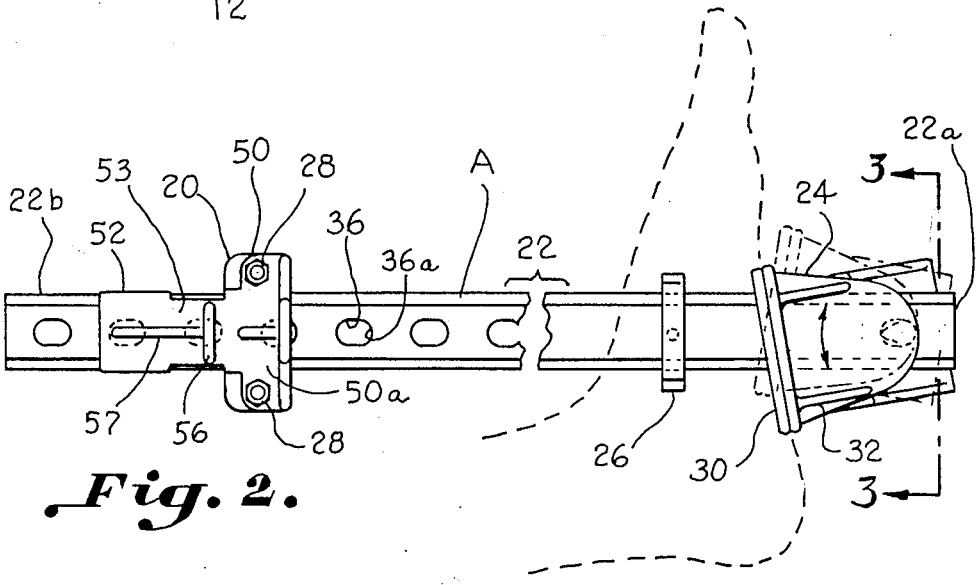
FIG. 2 is a side elevation of a foot brace constructed in accordance with the present invention as viewed from a side mounted position mounted to the side of a kayak hull.
Figure 3:
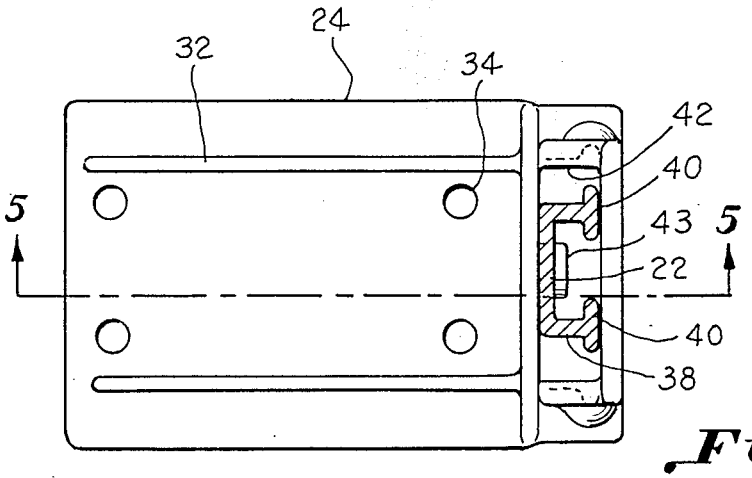
FIG. 3 is a sectional view taken along line 3—3 of FIG. 2.

As can best be seen in FIG. 2, brace bar means is provided by an elongated, extruded piece of material such as aluminum having a plurality of oval shaped openings 36. The extruded base bar has a generally U-shaped cross section as seen in FIG. 3. The legs 38 of the U have T-shaped flanges 40 formed thereon. An opening 42 in foot rest 24 receives the brace bar. There is sufficient clearance between brace bar 22 and the interior of opening 42 (FIG. 3) such that the foot rest may pivot about the brace bar in a rocking motion as can best seen in FIG. 2 for proper foot positioning.

Connection is made between foot rest 24 and brace bar 22 by means of a locking projection 43 carried on the foot rest. Locking projection 43 may fit in an opening 36 and includes a locking ridge 44 engaged by the edge **36*a* of an opening in a manner that the projection is retained in an opening once positioned by foot pressure. The entire foot rest 24 is preferably made of a one piece construction molded from a suitable polymeric material such as nylon, preferably glass-reinforced Nylon. The material may yield adequately to allow projection 43 to snap into openings 36 and be released therefrom. The rocking motion provided by the pivotal attachment of foot rest 24 to brace bar 22** allows the boater to move his foot to overcome fatigue and properly position the foot for bracing and rest.

Figure 5:
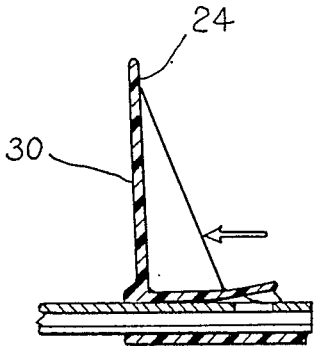
Figure 5:
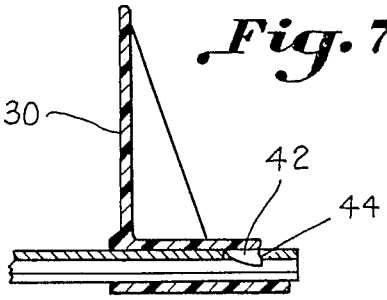

To move the position of foot rest 24, the foot rest projection which includes the planar surface 30 may be pulled forward as can best be seen in FIG. 5A releasing projection 42 so that the foot rest may either be pulled or the brace bar 22 moved to adjust the position of the foot rest and the brace bar relative to each other. While this does not provide the main adjustment feature of the foot brace, it does provide a gross adjustment in the position of the foot rest which may thereafter be fine adjusted in a manner to be more fully hereinafter explained.

Figure 6:
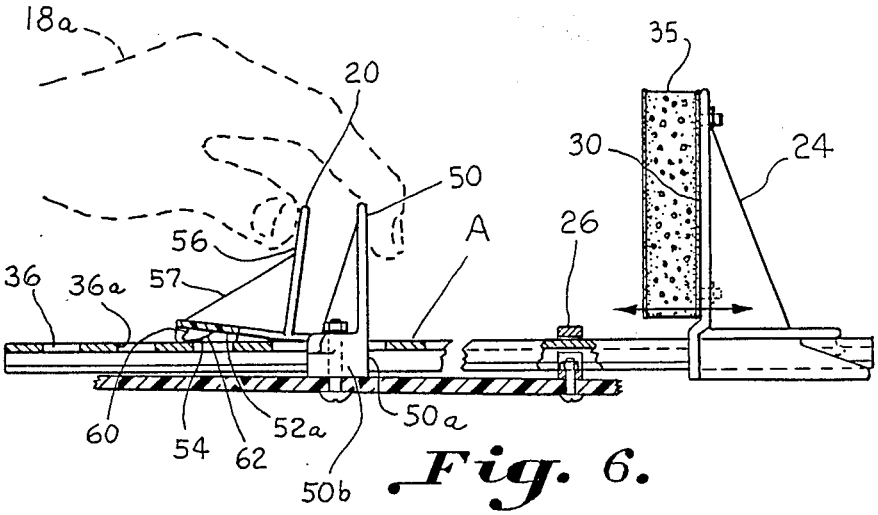
FIG. 6 is a top view of a foot brace mounted to the side of a kayak hull in accordance with the present invention wherein an adjusting bracket of the foot brace is in a released position so that the foot rest position may be adjusted.

Adjusting means is provided by the adjusting bracket 20 which includes an attachment bracket 50 and a cam bracket 52 which are preferably made as one piece together with a web 53 and a cam operator 56. The adjusting bracket is made from a material, such as glass-reinforced Nylon, which will enable cam operator 56 to be flexed, such as by pinching, relative to attachment bracket 50 and raise cam bracket 52. For this purpose, web 53 narrowly adjoins attachment bracket 50 and cam bracket 52 and acts as a hinge. Cam operator 56 extends from web 53 and a rib 57 connects cam operator 56 and cam bracket 52 (FIGS. 2 and 6). Attachment bracket 50 includes openings for attaching the adjusting bracket to the skin 12b of boat hull 12.

Figure 4:
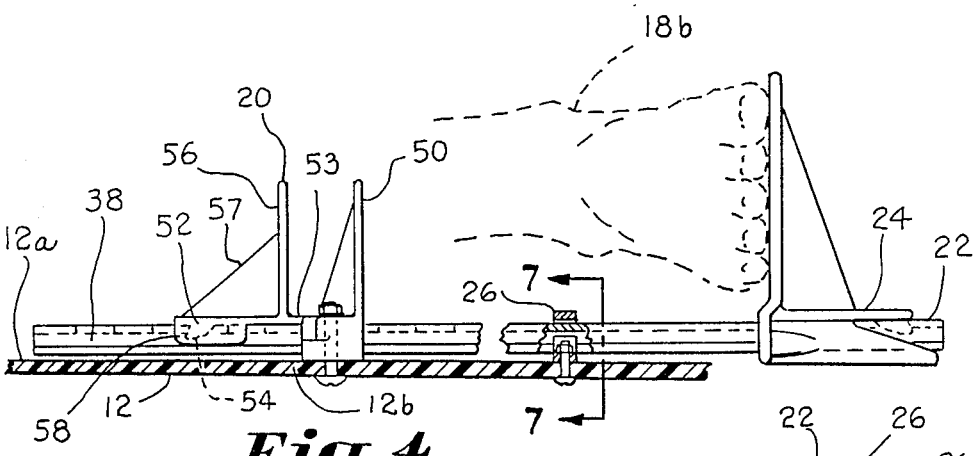
FIG. 4 is a top view of a foot brace mounted to the side of a kayak hull as constructed in accordance with the present invention.
Figure 7:
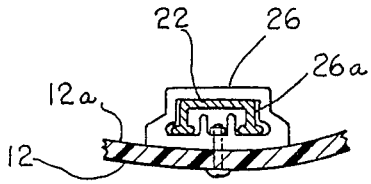
FIG. 7 is a sectional view taken along line 7—7 in FIG. 4.

Cam bracket 52 includes a pin 54 carried by a bottom surface 52a thereof. Cam bracket 52 further includes a pair of U-shaped legs 58 (FIG. 4) providing a generally square U-shaped cross section for the bracket. In this manner, cam bracket 52 may straddle the legs 38 of brace bar 22 for sliding contact. Pin 54 includes a camming ridge surface 60 which is slightly indented. Pin 54 is contoured to fit within openings 36 of the brace bar with the camming ridge surface locked by the edge **36*a* of an opening 36 in place. The pin includes a ramp surface 62 so that the pin and brace bar may slide relative to each other when adjusting bracket 20 is attached and the brace bar is moved in an aft direction as can best be seen in FIG. 6. However, when pressure is exerted upon foot rest 24, edge 36*a* of opening 36 and camming ridge 60 are urged together in an interlocking manner. FIG. 4 shows adjusting bracket 20 in a locked position and FIG. 6 shows the adjusting bracket in a released position. It will be noted that the cam operator 56 is operated manually by forward pressure as can best be seen in FIG. 6**.

In operation, with foot brace A attached by means of adjusting bracket 20 and intermediate bracket 26 to the interior **12*a* of hull 12, foot rest 24 may be easily and conveniently adjusted. Adjusting bracket 20 may be easily reached by a hand 18*a* of a boater while seated in cockpit 16 (FIG. 6). The foot 18*b* of the boater may be utilized to move foot rest 24 forward or aft as needed for adjustment when cam operator 56 moves pin 54 to the released position, as can best be seen in FIG. 6. When the desired position of foot rest 24 is reached cam operator 56 may be moved to allow pin 54 to be set in the closest opening 36. For this reason, some slight additional movement of foot rest 24 may be needed to insure that pin 54 is effectively locked in an opening 36. To change the foot rest position, the boater again need only reach down and operate cam operator 56 to release pin 54 whereupon foot rest 24** may again be adjusted forward or aft as desired.

Thus, it can be seen that an advantageous construction can be had for a foot brace for a kayak so that the foot brace may be readily operated from the cockpit area by the boater in a seated position while boating. The foot rest may be securely locked and released for adjustment by moving the foot rest by the foot of the boater as needed. Brace bar 22 slides readily as held in the slot **50*a* formed by the side legs 50*b* of attaching bracket 50 and as held between a correspondingly shaped slot 26*a* formed in intermediate bracket 26**. As in contrast to prior foot rests, where the adjusting member is located at the foot rest, the adjusting member in the present member is fixed in place at the cockpit and the bar slides to adjust the foot rest all of which provides for a readily and conveniently adjustable foot brace operable from the cockpit by the boater in a seated position, and without having to get out of the kayak.

While a preferred embodiment of the invention has been described using specific terms, such description is for illustrative purposes only, and it is to be understood that changes and variations may be made without departing from the spirit or scope of the following claims.

What is claimed is:

1. A foot brace for a kayak of the type having a hull with an upper deck, a cockpit having a cockpit opening formed in the deck and a cockpit seat carried within the hull accessible through the cockpit opening, said foot brace comprising:

an adjusting bracket carried by said hull adjacent said cockpit;

an elongated brace bar having a forward end and an aft end carried within said hull in a manner that relative movement in forward and aft directions is permitted between said brace bar and adjusting bracket within said hull;

a foot rest carried adjacent said forward end of said brace bar projecting laterally and outwardly towards a center of said hull so that a boater seated in said cockpit may rest and brace a foot on said foot rest;

adjusting means included within said adjusting bracket for adjusting the position of said brace bar in said forward and aft directions for affixing said foot rest in a desired position; and said adjusting bracket including an attaching bracket which is attached to the hull of said kayak and a cam bracket integral with said attaching bracket which is flexible in a manner that the cam bracket may be flexed with respect to said attaching bracket for releasing and locking said brace bar in said desired position.

2. The device of claim 1 wherein said adjusting bracket is affixed to the interior side of said hull and said brace bar slides relative to said adjusting bracket.

3. The device of claim 1 wherein said foot rest slides in said forward and aft directions relative to the interior of said hull and said foot rest may be separately adjusted on said brace bar in said forward and aft directions.

4. The device of claim 1 wherein said foot rest includes an open sleeve for slidably receiving said brace bar and a projection extending from said sleeve having a foot support surface.

5. The device of claim 4 wherein said foot rest comprises a locking projection within said sleeve for engaging in an opening formed in said brace bar for locking said foot rest in position.

6. The device of claim 5 wherein said projection includes a ridge which engages an edge of the opening of said brace bar when pressure is exerted on said foot support surface to assist in locking said foot rest in position.

7. The device of claim 1 wherein said adjusting bracket includes a cam bracket slidably engaging said brace and a pin carried by said cam bracket for engaging said brace bar and maintaining said brace bar in a locked forward-aft position relative to said adjusting bracket.

8. The device of claim 1 wherein said cam bracket includes a pin and a cam operator for moving said pin to lock and release said brace bar.

9. The device of claim 1 wherein said adjusting bracket comprises a pin and said brace bar comprises an opening in which said pin is received, said pin including a camming ridge surface for engaging against an edge of said opening of said brace bar for locking said adjusting bracket and brace bar together in said desired position under foot pressure.

10. A foot brace for a kayak having a hull and an upper deck with a cockpit having a cockpit opening formed in the deck and a cockpit seat carried in the hull accessible through the cockpit opening, said foot brace comprising:

elongated brace bar means having a forward end and an aft end carried by opposing sides of an interior of said hull in a manner that said brace bar means may slide in forward and aft directions relative to said hull and be fixed in a desired forward-aft position;

a foot rest carried by said forward end of said brace bar means projecting laterally and outwardly toward a center of said hull so that a boater seated in said cockpit may rest and brace a foot on said foot rest;

adjusting means carried by said hull spaced from said foot rest easily operable by a boater seated in said cockpit for engaging said brace bar means in a manner to lock said brace bar means in said desired forward-aft position and to release said brace bar means from said desired position while said boater is seated in said cockpit; and said adjusting means comprising a pin interlocking with said brace bar means and a cam operator easily reachable and operable manually by said boater while seated in said cockpit to lock and release said pin and the movement between said brace bar means and said adjusting means.

11. The device of claim 10 wherein said adjusting means is carried adjacent said aft end of said brace bar means and may be manually operated by the boater from the seat of the cockpit while seated.

12. The device of claim 10 wherein said foot rest is pivotally carried by said brace bar and includes a foot rest surface projecting in said lateral and outwardly projecting manner, said foot rest surface pivoting relative to said brace bar means for facilitating proper bracing and positioning of said foot.

13. The device of claim 10 wherein said adjusting means is affixed to the interior side of said hull and said brace bar means slides in said forward and aft directions relative to said adjusting means with said foot rest means affixed and carried adjacent the forward end of said brace bar means.

14. The device of claim 4 wherein said foot rest may be separately adjusted along the forward end of said brace bar means.

15. A foot brace for a kayak having a hull and an upper deck with a cockpit having a cockpit opening formed in the deck and a cockpit seat carried in the hull accessible through the cockpit opening, said foot brace comprising:

an elongated brace bar having a forward end and an aft end and carried by an interior side of said hull;

adjusting means manually operable from said cockpit seat carried by said hull in a manner that relative movement is permitted between said brace bar and said adjusting means;

a foot rest carried by a forward end of said brace bar in a direction away from said adjusting means, said foot rest projecting laterally and outwardly toward the center of said hull so that a boater seated in the cockpit may rest and brace a foot on said foot rest;

said adjusting means comprising locking means for locking the relative movement between said brace bar and said adjusting means so that the position of the foot rest towards and away from said cockpit seat may be adjusted to a desired forward-aft position; and said adjusting means includes a bracket slidably receiving said brace bar, a pin engaging said brace bar to lock the position thereof, and a manually operable cam operator for moving said pin to a lock and release position wherein said brace bar is locked and released for relative movement respectively.

16. The device of claim 15 wherein said adjusting means is carried adjacent an aft end of said brace bar spaced from said foot rest carried adjacent said forward end thereof in a manner that said adjusting means may be easily operable by the boater while seated to allow relative movement between said adjusting means and brace bar when said foot rest is acted upon by the foot of said boater to move said foot rest to said desired position.

17. The device of claim 15 wherein said pin, cam operator, and bracket are hinged together as one piece.

18. The device of claims 1, 10, or 15 wherein said foot rest includes a shock absorbing pad for absorbing shock between the boater's foot and foot rest to dissipate shock and prevent injury to the boater's ankle.

* * * * *